United States Patent [19]

Wesse

[11] 3,969,872

[45] July 20, 1976

[54] METHOD OF CONSTRUCTING MODULAR BUILDINGS

[76] Inventor: Harry M. Wesse, c/o Harry M. Weese and Associates, 10 W. Hubbard St., Chicago, Ill. 60610

[22] Filed: Oct. 30, 1972

[21] Appl. No.: 302,110

Related U.S. Application Data

[62] Division of Ser. No. 181,693, Sept. 20, 1971, Pat. No. 3,744,196.

[52] U.S. Cl. ..... 52/745; 52/79; 52/236

[51] Int. Cl.[2] ..... E04B 1/348

[58] Field of Search ..... 52/745, 79, 236; 264/295 X, 256, 228 X

[56] References Cited

UNITED STATES PATENTS

| | | | |
|---|---|---|---|
| 1,218,846 | 3/1917 | Farnquist | 52/70 |
| 2,607,099 | 8/1952 | Schröder | 264/228 |
| 2,645,114 | 7/1953 | Amirikian | 52/236 |
| 2,745,164 | 5/1956 | Ros | 264/228 |
| 2,751,635 | 6/1956 | Donnahue | 52/79 |
| 3,494,092 | 2/1970 | Johnson | 52/236 |
| 3,678,638 | 7/1972 | Mougin | 52/79 |
| 3,680,275 | 8/1973 | Romlet | 52/236 |

FOREIGN PATENTS OR APPLICATIONS

| | | | |
|---|---|---|---|
| 801,295 | 1/1951 | Germany | 52/745 |
| 176,283 | 8/1961 | Sweden | 52/70 |

*Primary Examiner*—Ernest R. Purser
*Assistant Examiner*—Henry Raduazo
*Attorney, Agent, or Firm*—Johnson, Dienner, Emrich & Wagner

[57] ABSTRACT

A method of constructing a modular building by casting reinforced slabs having embedded transverse hinge elements located at spaced intervals and folding the slabs into sleeve-like parallelogram modules or tunnels. The modules are stacked and grouted together in various arrangements to form a modular building.

3 Claims, 22 Drawing Figures

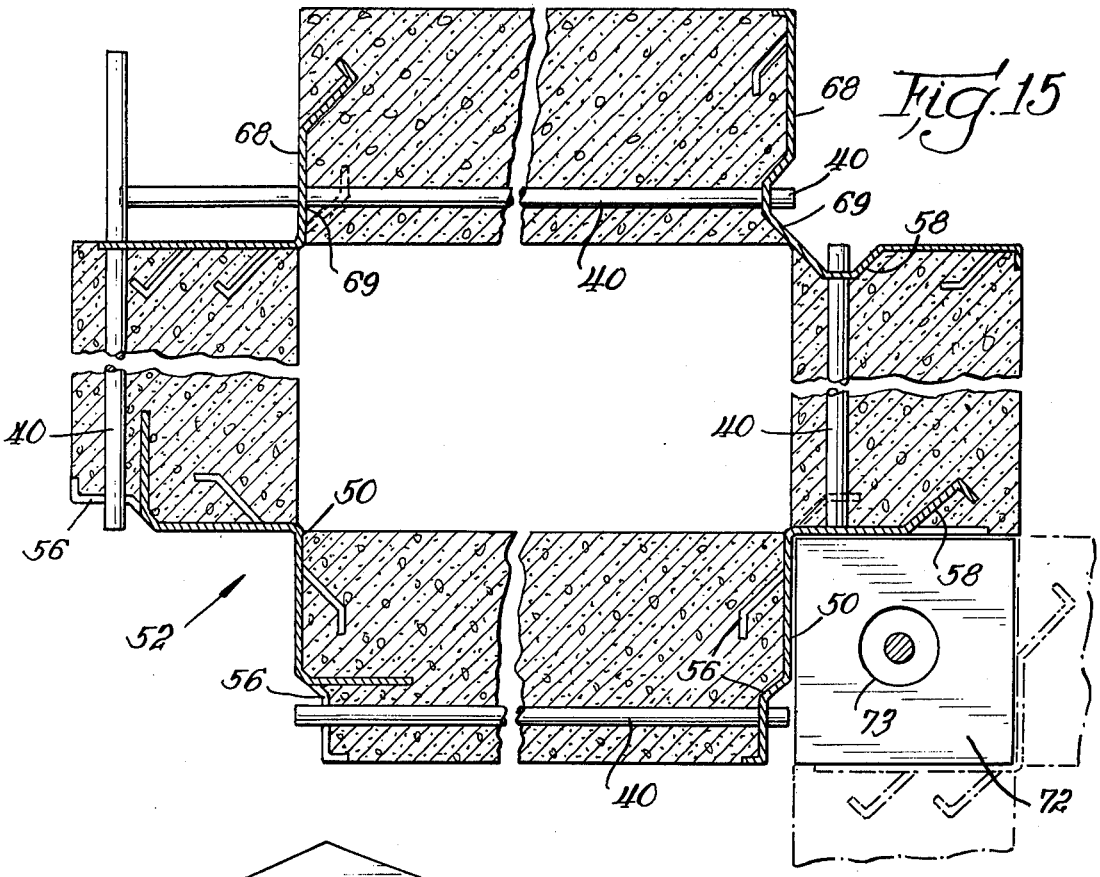
Fig. 15
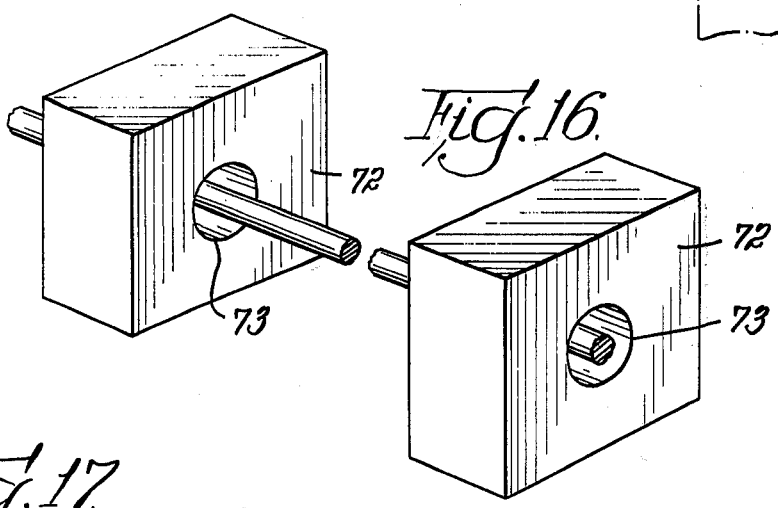
Fig. 16
Fig. 17
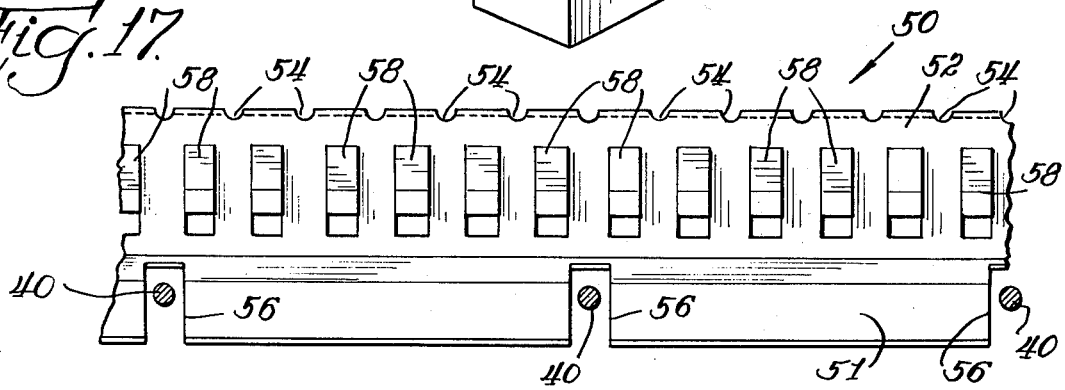

METHOD OF CONSTRUCTING MODULAR BUILDINGS

This is a divisional application of my copending application entitled "Hinged Slab System of Building" which was filed on Sept. 20, 1971 and identified as U.S. Ser. No. 181,693 now U.S. Pat. No. 3,744,196 of July 10, 1973

INTRODUCTION TO THE INVENTION

This invention relates to an efficient and economical method for constructing modular buildings and involves on-site extrusion or casting of structural components. These structural components are assembled in either single or multi-story structures to form buildings suitable as row houses or apartment buildings.

The process of this invention relates to casting and erection of a plurality of sleeve-like parallelogram modules consisting of joined side walls and end walls which are connected together in various arrangements to provide a modular building construction. In the most highly developed version, on-site continuous or semi-continuous longitudinally reinforced slabs are cast by using an extra wide paving machine with embedded transverse hinges disposed at selected intervals upon a casting bed which can be the ground floor slab.

These hinges are folded annealed metal strips having cut-out slots to interfit with the reinforcing wires and punched-out tabs embedded in the concrete slab. The hinges provide the means to fold the slabs into sleeve-like parallelogram modules and include a notch bearing surface to take the vertical loads of the horizontal slabs into the vertical slabs. These notches provide a gap for cutting the continuous reinforcing wires. The modules are then erected and grouted together by pumping through a hole in a shim block.

Interior modules, such as bathrooms, kitchens, and stairs, are inserted into the structure before facade structures close the end of the parallelogram modules.

DESCRIPTION OF DRAWINGS

For a better understanding of this invention, reference may be made to the accompanying drawings, in which:

FIG. 15 depicts the parallelogram module identical to FIG. 14 in its assembled position;

FIG. 16 is a perspective view of a shim used during the grouting of a plurality of parallelogram modules;

FIG. 17 is a side elevational view of one embodiment of a novel hinge element;

DESCRIPTION OF PREFERRED EMBODIMENTS

Referring to FIGS. 1 through 8, there are shown diagrammatic representations of modular units that are assembled to form one-story (FIG. 1), two-story (FIG. 2) and three-story (FIG. 3) buildings.

Figure 1:
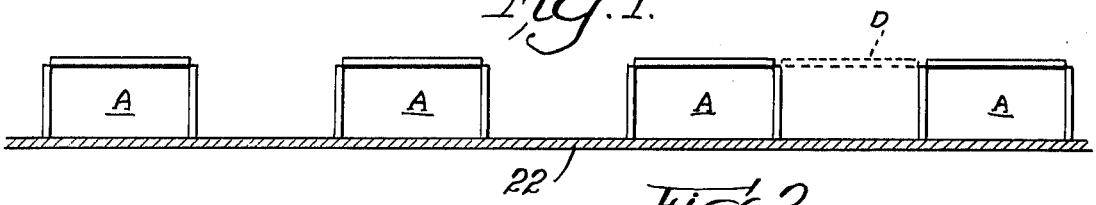
FIG. 1 is a diagrammatic front view of a series of three-sided modular units.
Figure 2:
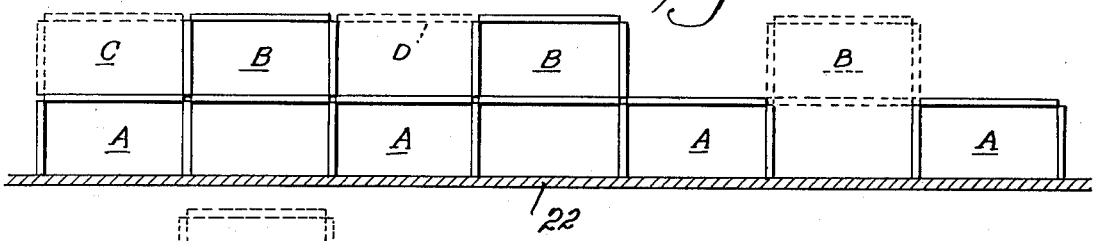
FIGS. 2–3 are diagrammatic front views of additional modular units assembled together with the modular units of FIG. 1 to form a building structure.
Figure 3:
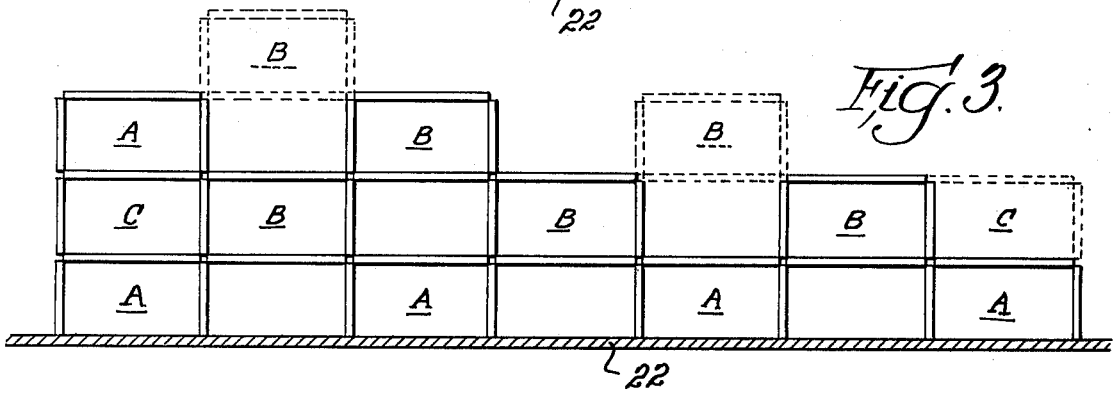
Figure 4:
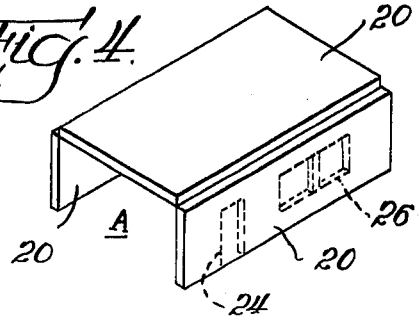
FIGS. 4–8 are diagrammatic perspective views, respectively, of a three-sided parallelogram module, a four-sided parallelogram module, a two-sided slab, a one-sided slab, and a three-sided parallelogram module.
Figure 6:
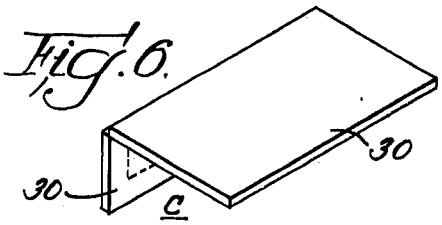
Figure 7:
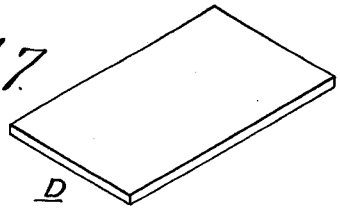
Figure 5:
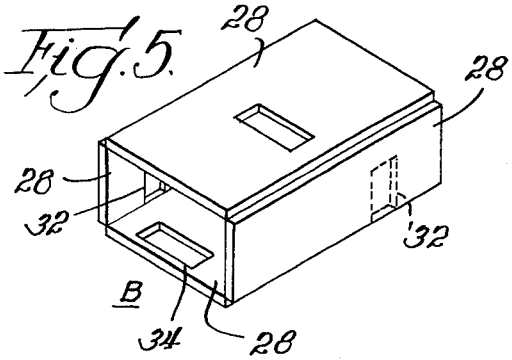
Figure 8:
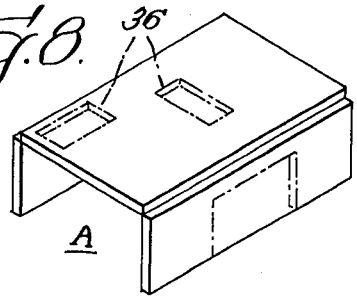

FIG. 4 depicts three slabs 20 hinged together to provide a three-side unit A, which when set up on a base slab 22 (FIGS. 1-3) forms a sleeve-like module. In FIG. 1, adjacent units A are interconnected by a single slab D (FIG. 7) to produce a one-story structure. Outer and inner doors 24 and windows 26 can be formed in the side walls of units A. To complete the one-story structure of FIG. 1, it would, of course, be necessary to seal off the open ends.

To construct a two-story structure, four-sided units B (FIG. 5) comprising four hingedly-connected together slabs 28 are seated between the upper corners of adjacent spaced three-sided units A, and an end module is formed by adding a two-sided slab unit C (FIG. 6) comprising two hingedly connected slabs 30. Single slab D (FIG. 7) could be connected as shown in FIG. 3 between the upper corners of the B units to complete the second level. The four-sided units B likewise have inner and outer doors 32. At least one of the B units (FIG. 5) and one of the A units (FIG. 8) have formed openings 34 and 36 for a stairway entrance to the second level.

The invention is directed to a method for making and assembling hingedly-connected slabs to selectively build modular buildings as diagrammatically depicted in FIGS. 1 through 8.

Figure 9:
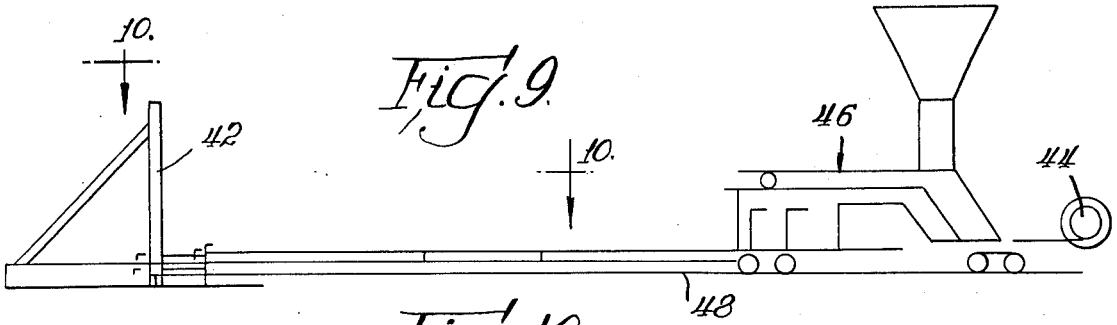
FIG. 9 is a diagrammatic side view of the assembly used to provide on-site reinforced slabs constructed in accordance with the principles of this invention.
Figure 10:
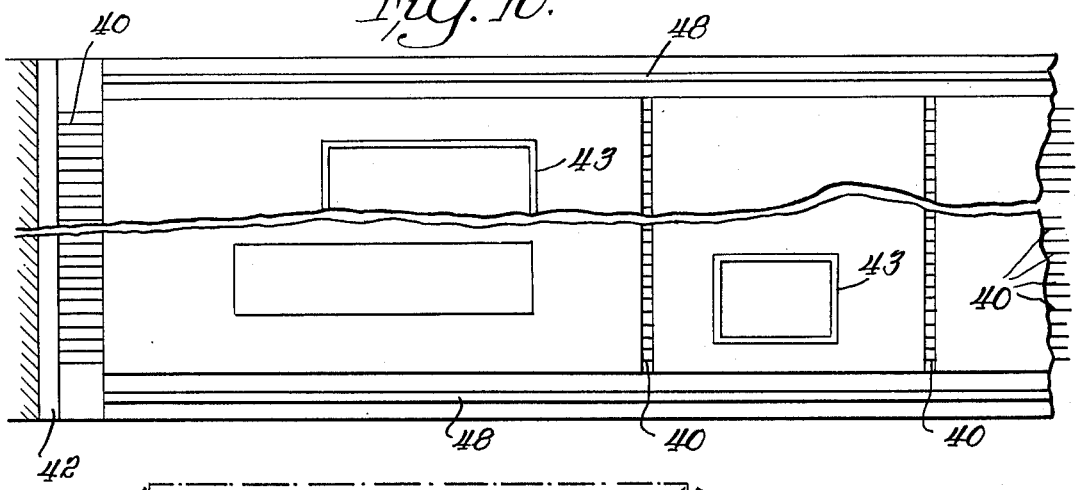
FIG. 10 is a plan view of the portion of FIG. 9 shown between the arrows 10—10.

In FIGS. 9 and 10, there is diagrammatically shown an on-site system for making the sleeve-like parallelogram modules in accordance with the principles of this invention. A plurality of closely-spaced longitudinally extending prestressed reinforcing wires 40 (FIG. 10) are connected between an end anchor 42 and a tensioning reel 44. An extra wide paving machine 46 guided on rails 48 moves away from anchor 42 to pour a first layer and then returns to its starting position to lay a second layer. A parting agent is used to separate the two layers and openings 43 are box outs for stairwells, windows, doors, etc. Novel hinge elements 50 (FIG. 14) are embedded at selected intervals transverse to the reinforcing wires 40 to permit the casted slabs to be folded into open-ended sleeve-like parallelogram modules 52 (see FIGS. 11 and 12).

Figure 14:
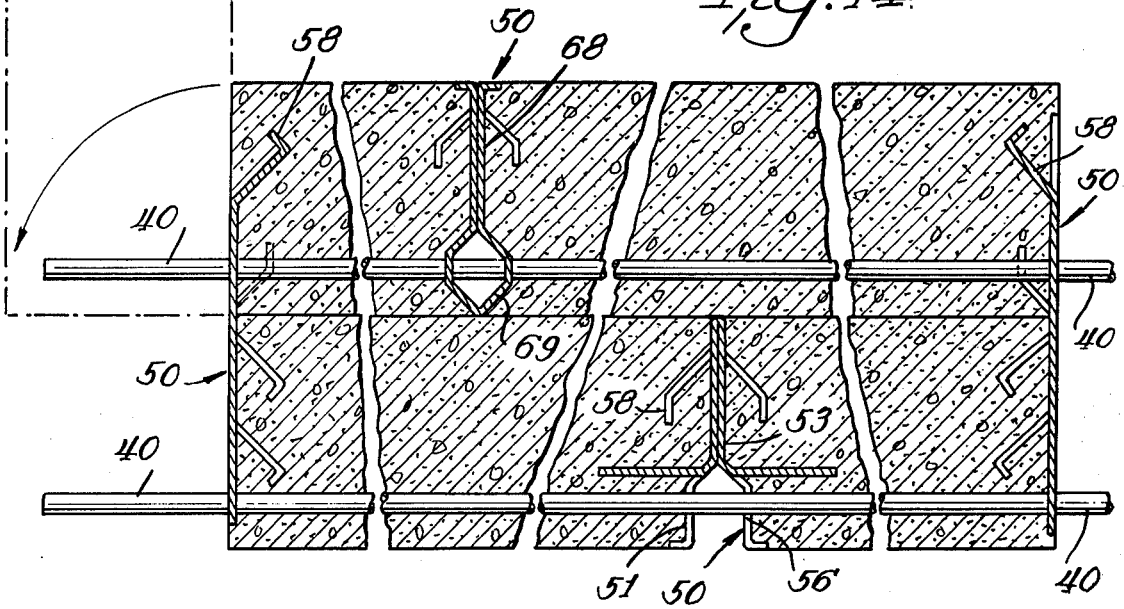
FIG. 14 depicts a parallelogram module embodying the principles of this invention in the unassembled position.
Figure 18:
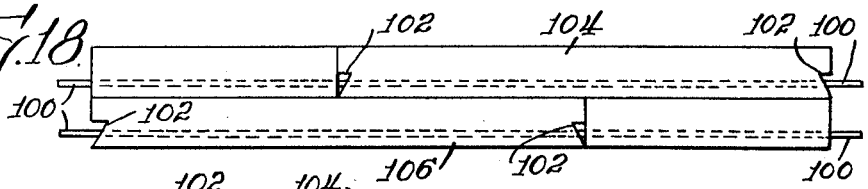
FIG. 18 is another embodiment of a four slab unit constructed in accordance with the principles of this invention prior to being assembled into a parallelogram module.
Figure 19:
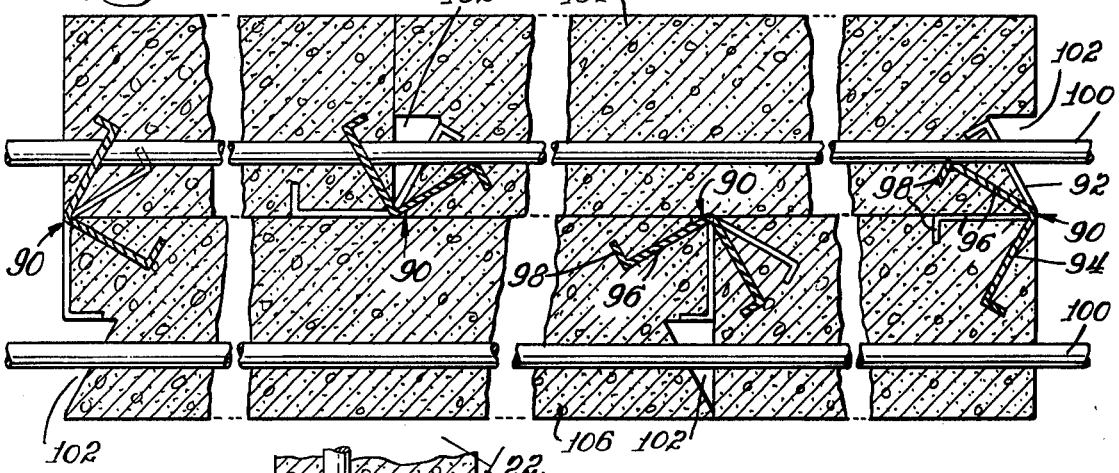
FIG. 19 is a partial enlarge vertical longitudinal sectional view of FIG. 18 taken in the vertical plane of the longitudinal reinforcing rods.

One embodiment of the novel hinge element 50 is depicted in FIG. 17, and comprises an elongated metal strip 52 folded lengthwise into two equal portions to define hinge plates 51 and 53 (FIG. 14). Notches 54 are provided along its longitudinal centerline to induce bending, and along its longitudinal edge are cut-outs 56 (FIG. 17) spaced apart an amount equal to the distance between reinforcing wires 40 for straddling these wires, which leaves access for cutting the reinforcing wires 40 between the slabs. Tabs 58 are punched out along both sides of the folded portions of the strip 52 and are bent into a hook shape for anchoring in adjacent slabs to provide a hinging effect between slabs.

Figure 11:
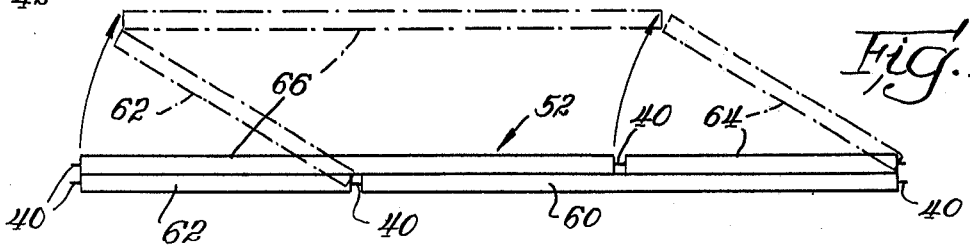
FIG. 11 is a four-slab unit constructed in accordance with the principles of this invention prior to being assembled into a sleeve-like parallelogram module.

FIG. 14 depicts a parallelogram module 52 before it is set up. The two lower slabs 60 and 62 are extruded on the first pass of the paving machine and the two upper slabs 64 and 66 are extruded on the second pass. It is of course necessary to bend half of the two exterior hinge elements 50—50 upwardly before the second pass. Spacers (not shown) hold the opposite ends of the slabs in place during curing. When cured, the upper slabs comprising an end wall 64 and a side wall 66 are swung in the direction of the arrows from the solid line position of FIG. 11 (dotted line in FIG. 11 shows intermediate position) to the position of FIG. 12.

Figure 12:
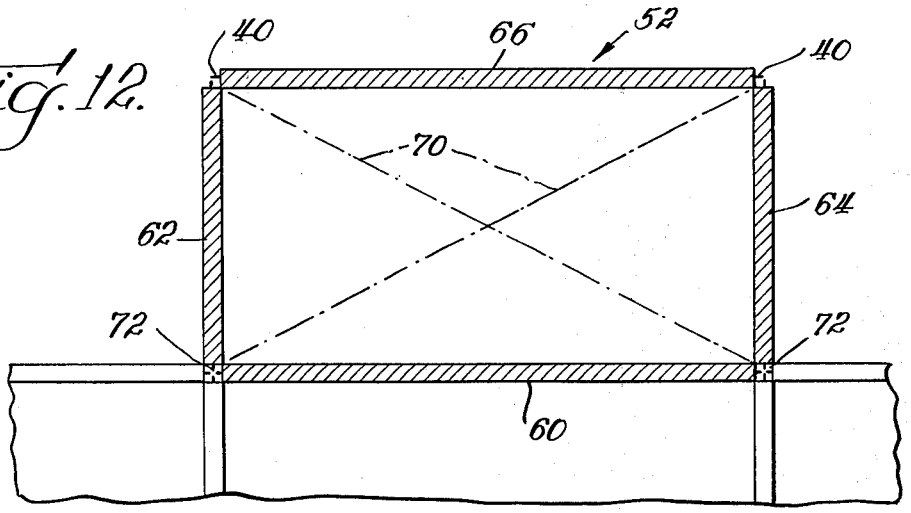
FIG. 12 is a four-slab unit depicted in FIG. 11 shown in the assembled position above and between two other already set slab units.

FIG. 12 shows the stacking and assembly of a parallelogram module 12 above and between two already set modular units. A jig or brace 70 is used to keep the module square while the square-shaped space 71 formed by the adjoining corners is filled with grout through a hole 73 in the shims 72 (FIG. 16).

The hinge elements shown in FIG. 14 are adapted to swing counterclockwise. The hinge element 68 in the upper layer is identical to hinge element 50 in the lower layer except hexagon-shaped cut-outs 69 are provided to accommodate the rods 40 instead of slots 56 used in hinge 50. These cut-outs are sufficiently large to permit access for cutting reinforcing wires 40.

FIG. 15 shows a parallelogram module 52 in its set-up position with its lower right corner grouted to the upper left corner of another parallelogram module. The shim 72 (FIG. 16) is disposed in the square-shaped gap 74 before filling it with grout. Thus, the parallelogram modules bear on shims and the pumped grout without any overlap of the precast segments, i.e., bearing forces are carried from upper walls to lower walls on the grout infill, which also fill the notches in supporting the floors.

Figure 13:
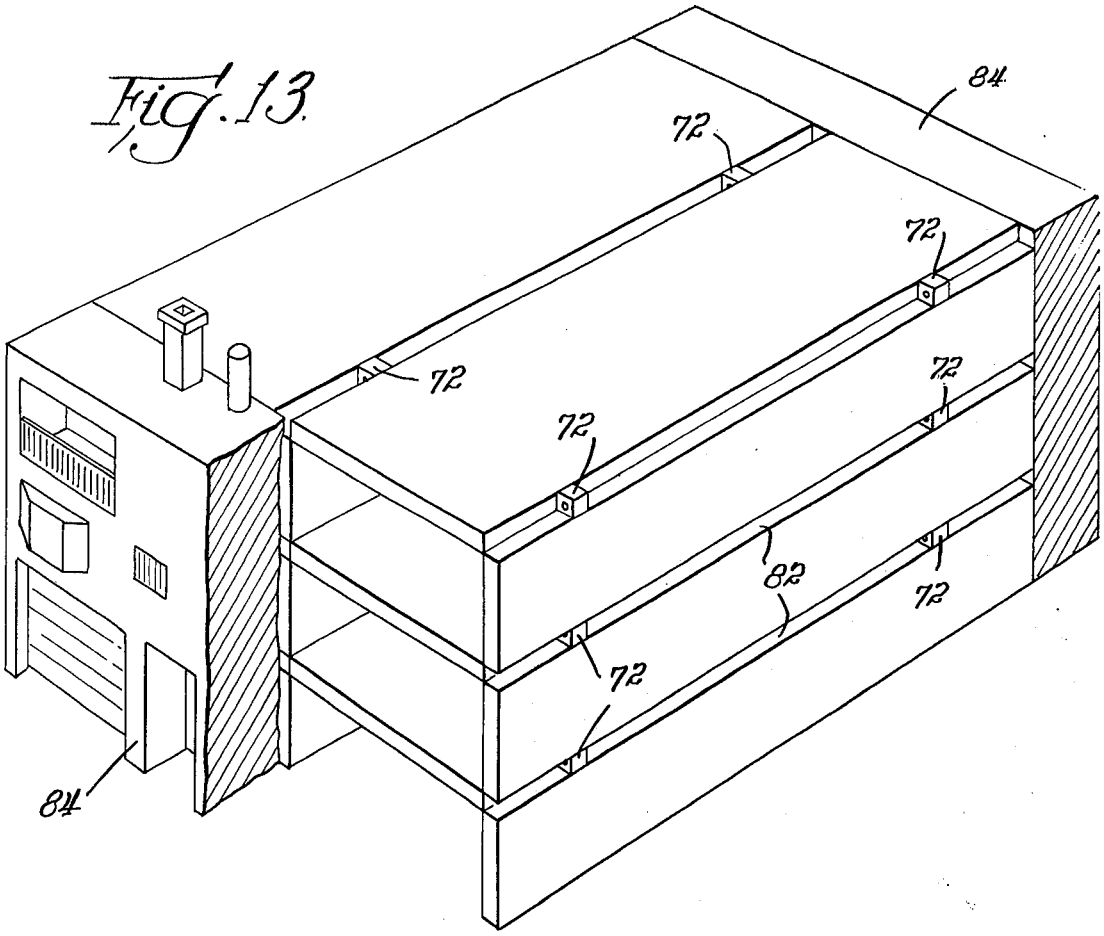
FIG. 13 is a front perspective view of a three-story building constructed in accordance with the principles of this invention.

FIG. 13 shows a front perspective view of a three-story building 80 constructed by assembling a plurality of parallelogram modules made and grouted together in accordance with the foregoing description. An end filler 82 fills the recess formed between the outside corner edges of adjacent slabs. The open ends are closed with a facade structure 84 which is manufactured off-site. These structures are self-supporting and contain mechanical equipment such as furnaces, boilers, air conditioning units, electric and gas meters, fuse boxes, fireplaces, closets, balconies, etc.

Site finishing is limited to an optional skim coating of concrete surfaces, dry walling the stud assemblies, underlayment, flooring, exposed wiring, plumbing connections to modules, painting, carpeting, and the hanging of pre-fit doors.

There is shown in FIGS. 18–22, another version of a parallelogram module which is formed in the same manner as described hereinbefore. The hinge element 90 is made of an elongated metal strip which is folded along its centerline into two equal portions to define a pair of hinge plates 92 and 94. Tabs 96 having hook ends 98 are cut transversely to its centerline, and are bent so that transverse reinforcing wires 100 interleave between alternate tabs that are separated by an acute angle to provide an alternate staggered arrangement.

Figure 20:
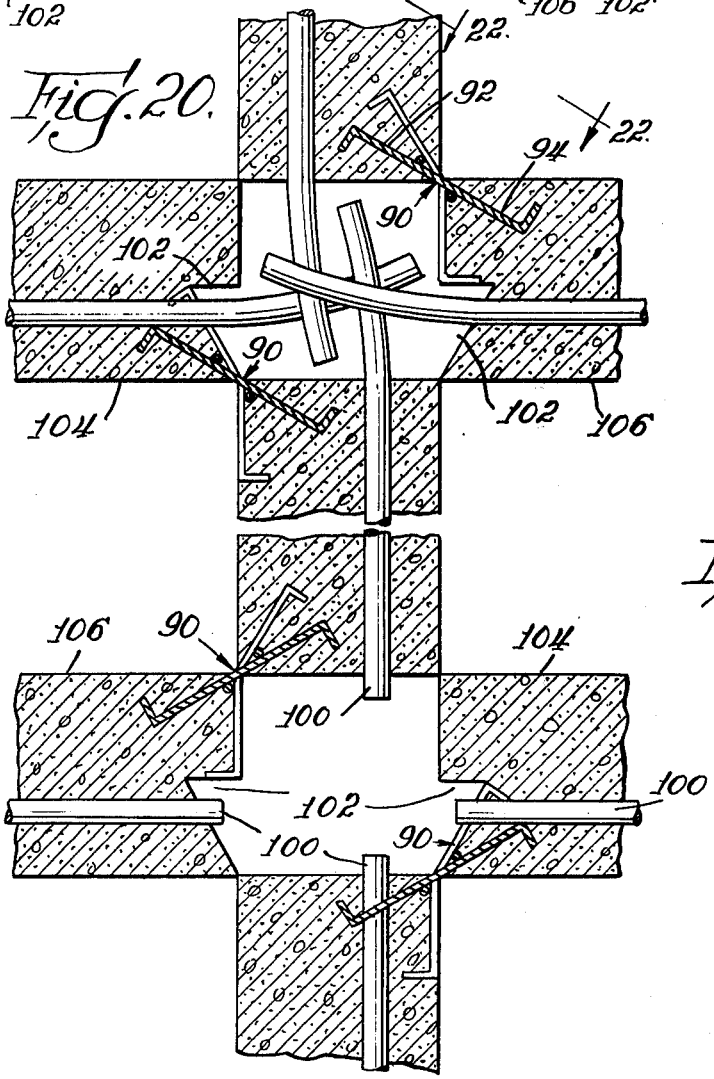
FIG. 20 is a partial broken-away cross-sectional view of the four slab unit of FIG. 18 showing the parallelogram module mounted on two other already-set modules.
Figure 21:
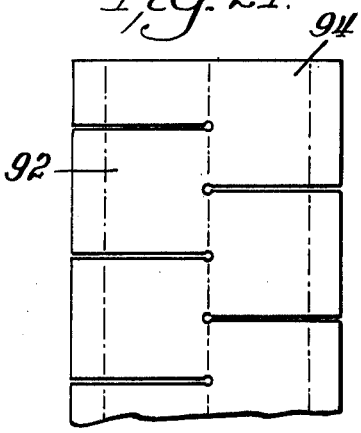
FIG. 21 shows a second embodiment of a novel hinge element used in the FIGS. 18–20 embodiment.
Figure 22:
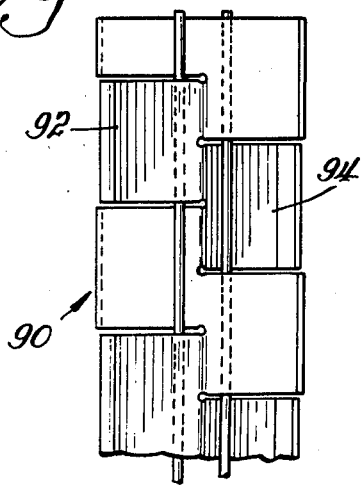
FIG. 22 is a face view of the hinge of FIG. 21 shaped in the form shown in cross-section in FIG. 20 and with transverse reinforcing wires interleaved between its tabs.

Triangular shaped recesses 102 are formed at the ends of the longest pair of slabs 104 and 106. The purpose of these recesses is to provide a means for gaining access to the longitudinally extending reinforcing wires 100, which pass through the recesses 102. As shown in FIG. 20, the ends of the reinforcing wires at the exterior hinges are of such a length to intertwine and thereby provide continuity to one-half the joints.

Many changes could be made in the above described modular building method without departure from the scope of the claims, it is intended that all matter contained in the above description shall be interpreted as illustrative and not in a limiting sense.

Having now particularly described and ascertained the nature of the invention, and in what manner the same is to be performed, what is claimed is:

1. Method of constructing a building module of four connected lateral walls comprising casting two separate oblong layers of concrete superposed on each other with a series of reinforcing rods extending lengthwise of and embedded in each layer, attaching unfolded hinges between the two layers at their ends, embedding folded intermediate hinge means in each layer, allowing said layers to set, and thereby attaching the hinge leaves to the adjacent edges of the respective layers, then cutting the reinforcing rods at said intermediate hinge means, and then separating and moving the two layers into a four-sided hollow module by bending said hinge means.

2. The method of making a four-walled building module which comprises casting an oblong horizontal slab of concrete, disposing a reinforcing rod throughout the length of said slab, dividing said slab into two sections by interposing a folded sheet metal hinge intermediate said sections, severing said rod at said hinge, engaging and bonding said slab at each of its outer ends to one leaf of an unfolded sheet metal hinge, casting a second slab on top of the first slab, disposing a reinforcing rod throughout the length of said second slab, dividing said second slab into two sections of the same lengths as the sections of the first slab, and joining said sections of said latter slab by a folded sheet metal hinge, joining the outer ends of said sections to the afore unfolded sheet metal hinges, then cutting said rods at said folded hinges, then separating the sections by swinging them upon said hinges to form a four-sided open ended module.

3. The method of producing a rectangular module of two parallel rectangular end walls and two parallel rectangular side walls which comprises laying a slab of concrete of a length equal to one side wall plus one end wall, disposing a folded sheet metal hinge in closed position with its free ends extending downwardly to be embedded in said slab, said hinge dividing the slab into an end wall portion and a side wall portion, attaching sheet metal hinges in open position across the ends of both portions, laying a second slab on top of the first slab, said second slab extending the full distance between the last-named hinges and being of the same width as the first laid slab, embedding a folded sheet metal hinge in the folded position across the width of the second slab and embedding the same with the closed edge of the hinge extending downwardly toward the first slab and bonding its leaves to the ends of the adjacent end wall section and side wall section of the second slab, simultaneously bonding the outer ends of the second slab to the upper leaf of the open sheet metal hinges at the ends of the first slab, allowing the slabs to harden and separating the layers of the two slabs by opening said closed hinge of the second slab and of the first slab by substantially 90° and partially closing the open hinges at the outer ends of both slabs.

* * * * *